United States Patent [19]

Wahlers et al.

[11] 4,293,838

[45] Oct. 6, 1981

[54] RESISTANCE MATERIAL, RESISTOR AND METHOD OF MAKING THE SAME

[75] Inventors: Richard L. Wahlers, Churchville, Pa.; Vernon E. Osborne, Boone, N.C.

[73] Assignee: TRW, Inc., Cleveland, Ohio

[21] Appl. No.: 7,433

[22] Filed: Jan. 29, 1979

[51] Int. Cl.[3] ..... H01C 1/012

[52] U.S. Cl. ..... 338/308; 29/620; 219/543; 219/553; 252/507; 252/518; 252/520; 428/428; 427/126.1

[58] Field of Search ..... 338/308, 309, 552, 553; 219/345, 522, 543; 252/512, 513, 518, 519, 507, 520; 428/428, 432; 427/102, 123, 126; 106/47 R; 29/620

[56] References Cited

U.S. PATENT DOCUMENTS

| | | | |
|---|---|---|---|
| 3,044,901 | 7/1962 | Garnsworthy | 428/432 |
| 3,180,841 | 4/1965 | Murphy | 252/515 |
| 3,304,199 | 2/1967 | Faber, Sr. et al. | 428/426 |
| 3,358,362 | 12/1967 | McElroy | 29/621 |
| 3,394,087 | 7/1968 | Huang et al. | 252/512 |
| 3,669,907 | 6/1972 | Kohashi et al. | 252/518 |
| 3,794,518 | 2/1974 | Howell | 428/428 |
| 3,888,796 | 6/1975 | Nigol | 252/518 |
| 3,914,514 | 10/1975 | MacKenzie et al. | 428/426 |
| 3,915,721 | 10/1975 | Kamigaito et al. | 106/46 |
| 3,923,698 | 12/1975 | Kamigaito et al. | 252/518 |
| 4,039,997 | 8/1977 | Huang et al. | 338/308 |
| 4,060,663 | 11/1977 | Merz et al. | 428/428 |
| 4,065,743 | 12/1977 | Wahlers et al. | 338/308 |
| 4,137,519 | 1/1979 | Hodge | 338/308 |
| 4,146,677 | 3/1979 | Merz et al. | 428/428 |
| 4,172,922 | 10/1979 | Merz et al. | 428/432 |
| 4,203,025 | 5/1980 | Nakatani et al. | 219/216 |

FOREIGN PATENT DOCUMENTS

| | | | |
|---|---|---|---|
| 812858 | 6/1959 | United Kingdom | 252/518 |
| 1538144 | 1/1979 | United Kingdom | 338/308 |

*Primary Examiner*—Volodymyr Y. Mayewsky
*Attorney, Agent, or Firm*—Jacob Trachtman

[57] ABSTRACT

A vitreous enamel resistor material comprising a mixture of a vitreous glass frit, an insulating material containing an oxide of zirconium, and a conductive phase of fine particles of tin oxide. The insulating material is selected from the group consisting of zirconia ($ZrO_2$), calcium zirconate ($CaZrO_2$), barium zirconate ($BaZrO_3$) and strontium zirconate ($SrZrO_3$), and the conductive phase may also contain an additive such as tantalum oxide. An electrical resistor is made from the resistor material by applying the material to a substrate and firing the coated substrate to a temperature at which the glass softens. Upon cooling, the substrate has on the surface thereof a film of glass and insulating material having the particles of the conductive phase embedded therein and dispersed therethroughout. The resistor material provides a resistor having relatively high resistivity as well as rugged physical characteristics.

23 Claims, 2 Drawing Figures

RESISTANCE MATERIAL, RESISTOR AND METHOD OF MAKING THE SAME

Figure 1:
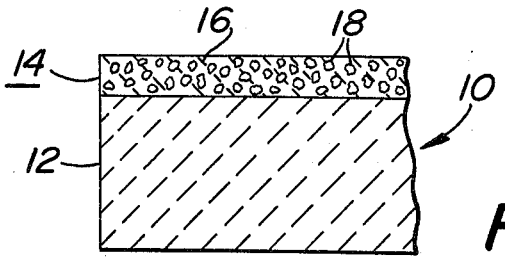

The invention relates to a resistor material, resistors made from the material, and a method of making the resistance material and resistor. More particularly, the present invention relates to a vitreous enamel resistor material which provides a resistor having a high resistivity as well as rugged physical characteristics, and which is made from relatively inexpensive materials.

A type of electrical resistor material which has come into commercial use in a vitreous enamel resistor material which comprises a mixture of glass frit, and finely divided particles of an electrical conductive material. The vitreous enamel resistor material is coated on the surface of a substrate of an electrical insulating material, usually a ceramic, and fired to soften the glass frit. When cooled, there is provided a film of glass having the conductive particles dispersed therein.

Since electrical resistors having a wide range of resistance values are desirable, there is a need for vitreous enamel resistor materials with respective properties which will allow the making of resistors over a wide range of resistance values. Resistor materials which provide high resistivities have generally utilized noble metals as conductive particles and are therefore relatively expensive. Recently, however, relatively inexpensive vitreous enamel resistor materials have been provided utilizing tin oxide ($SnO_2$). Tin oxide and additives have also been utilized for making vitreous enamel resistor materials and resistors, and U.S. Pat. No. 4,065,743 which issued Dec. 27, 1977 entitled Resistor Material, Resistors Made Therefrom And Method Of Making The Same, discloses a vitreous enamel material utilizing a conductive phase of tin oxide ($SnO_2$), and tantalum oxide ($Ta_2O_5$) as an additive.

In utilizing such vitreous enamel resistance materials having a conductive phase of tin oxide ($SnO_2$), or tin oxide and an additive such as tantalum oxide ($Ta_2O_5$), the resistivity of the material is increased by reducing the proportion of the conductive material. The volume of glass may be between 20% to 80% with a corresponding volume of the conductive material between 80% to 20%. The preferred range, however, for the tin oxide content is between 40 and 60% by volume. However, when the content of the conductive phase is reduced below 40% by volume, and the glass content is correspondingly increased to over 60% by volume, the glaze bloats and becomes very frothy during the firing of the material to produce the resistor. The glaze material under such circumstances provides a resistive layer which is distorted by having an increased thickness, and is weakened and readily subject to chipping and breakage. Because of this difficulty, such resistors have been made with a glass content having an upper limit of 60% by volume of glass, and preferably a content of not greater than 50% by volume. This restricts to use of such materials and their ability to provide resistors of increased resistivity which would otherwise be afforded by the use of higher glass content.

In the art of making vitreous enamel resistors, it has also been found that increasing the temperature at which a vitreous enamel material is fired during the making of the resistor, often results in providing or increasing desirable electrical characteristics of a resistor, such as its temperature stability. Such an increase in the firing temperature, however, also at the same time usually reduces the resistivity of a resistor. Therefore, in order to produce a resistor of desired resistivity, it was found necessary to sufficiently increase the glass content to allow for the reduction of resistivity resulting from the firing of the resistive material at increased temperature. However, as noted, the glass content for such resistors, has been limited to 60% by volume and preferably to 50% by volume in order to avoid undesirable physical charactristics resulting when a glass loading of over 60% is utilized.

It is therefore an object of the invention to provide a new and improved resistance material and resistor made therefrom.

It is another object of the invention to provide a new and improved vitreous enamel resistance material and a resistor made therefrom.

It is still another object of the invention to provide a new and improved vitreous enamel resistor with a conductive phase including tin oxide having a relatively high resistivity as well as rugged physical characteristics.

It is another object of the invention to provide a new and improved vitreous enamel resistance material having a conductive phase of tin oxide and tantalum oxide and a relatively high resistivity as well as rugged physical characteristics.

Another object of the invention is to provide a new and improved vitreous enamel resistance material producing resistivities which are relatively insensitive to variations in firing temperature during the manufacturing process.

Another object of the invention is to provide a new and improved vitreous enamel resistance material allowing the firing temperature to be increased to an optimum value while providing a relatively high resistivity as well as rugged physical characteristics.

Another object of the invention is to provide a new and improved vitreous enamel resistance material, resistor and method of making same having a conductive phase including tin oxide, and which is relatively inexpensive.

Other objects will appear hereinafter.

These objects are achieved by a resistance material comprising a mixture of a glass frit, an insulating material containing an oxide of zirconium, and a conductive phase of finely divided particles of tin oxide ($SnO_2$), and an additive such as tantalum oxide ($Ta_2O_5$) if desired. The insulating material is selected from the group consisting of zirconia ($ZrO_2$), calcium zirconate ($CaZrO_3$), barium zirconate ($BaZrO_3$), and strontium zirconate ($SrZrO_3$).

The invention accordingly comprises a composition of matter, resistor and method of making same, possessing the characteristics, properties, and the relation of components which are exemplified in the description and compositions hereinafter provided, and the scope of the invention is indicated by the claims.

Figure 2:
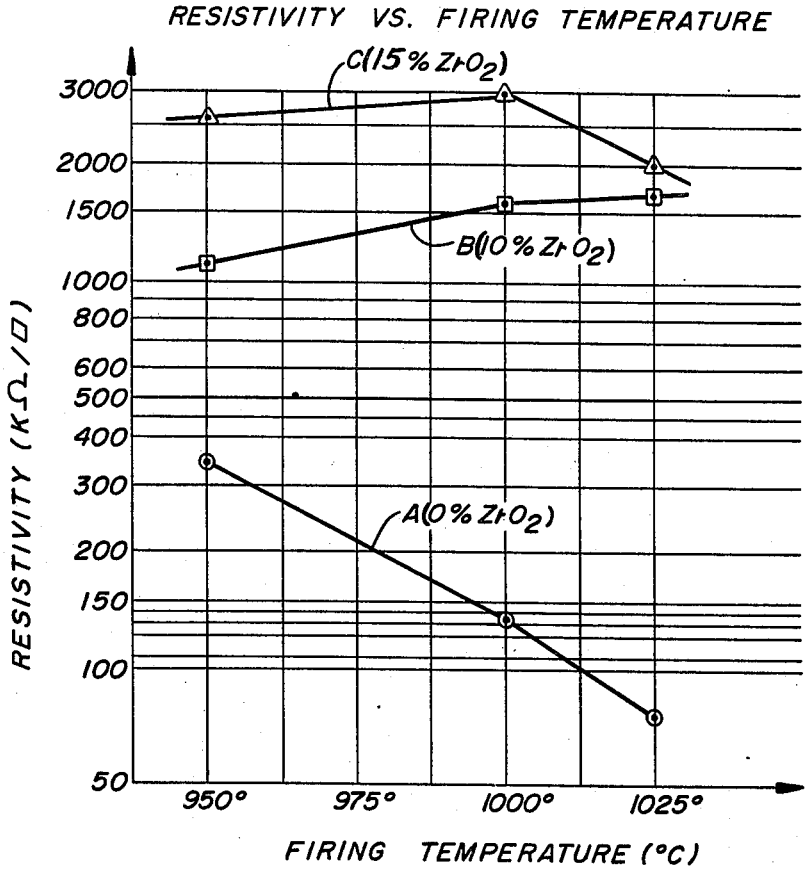

For fuller understanding of the nature and objects of the invention, reference should be had to the following detailed descrition taken in connection with the accompanying drawing, in which:

FIG. 1 is a sectional view of a portion of a resistor made with the resistor material of the present invention; and FIG. 2 is a graph comparing resistivity with firing temperature for resistors of the present invention and those made of a prior art resistance material.

In general, the vitreous enamel resistance material of the present invention comprises a mixture of a vitreous glass frit, insulating material containing an oxide of zirconium, and a conductive phase of fine particles of tin oxide ($SnO_2$) The conductive phase may also include an additive material such as tantalum oxide ($Ta_2O_5$) as taught in U.S. Pat. No. 4,065,743. The glass frit may be present in the mixture in the amount of about 30% up to about 60% by volume, and preferably in the amount of about 35% to 40% by volume. Theinsulating material is an oxide of zirconium, such as zirconia ($ZrO_2$), calcium zirconate ($CaZrO_3$), barium zirconate ($BaZrO_3$), and strontium zirconate ($SrZrO_3$), in an amount of up to about 15% and higher if desirable, and preferably between 10% and 15%, by volume of the mixture. A total content of glass frit and additive material of 50% by volume of the resistance material is preferred, although an amount of 60% and as high as 70% by volume may be used. The preferred amount of tin oxide ($SnO_2$) is 40 to 60% by volume of the mixture and when tantalum oxide ($Ta_2O_5$) is utilized, it is added to the tin oxide ($SnO_2$) in an amount of up to 50% by weight of the conductive phase.

The glass frit used may be any of the well known compositions used for making vitreous enamel resistor compositions which has a melting point below that of the conductive phase. However, it has been found preferable to use a borosilicate frit, and particularly an alkaline earth borosilicate frit, such as a barium or calcium borosilicate frit. The preparation of such frits is well known and consists, for examle, of melting together the constituents of the glass in the form of the oxides of the constituents, and pouring such molten composition into water to form the frit. The batch ingredients may, of course, be any compound that will yield the desired oxides under the usual conditions of frit production. For example, boric oxide will be obtained from boric acid, silicon dioxide will be produced from flint, barium oxide will be produced from barium carbonate, etc. The coarse frit is preferably milled in a ball mill with water to reduce the particle size of the frit and to obtain a frit of substantially uniform size.

The resistor material of the present invention may be made by thoroughly mixing together the glass frit, the insulating material, tin oxide particles, and tantalum oxide particles when used, in an appropriate amount.

To make the resistor with the resistance material of the present invention, the resistance material is applied to a desired thickness on the surface of a substrate. The substrate may be a body of any material which can withstand the firing temperature of the resistor material. The substrate is generally a body of an insulator, such as ceramic, glass, porcelain, steatite, barium titanite, or alumina. The resistance material may be applied as a layer on the substrate by brushing, dipping, spraying, or screen stencil application. The substrate with the resistance material coating is then fired in a conventional furnace at a temperature at which the glass frit softens, but below the point at which the tin oxide melts. The resistor materials are preferably fired in a inert or non-oxidizing atmoshere, such as provided by argon, helium, or nitrogen. The particular firing temperature used depends upon the softening temperature of a particular glass frit used. When the substrate and resistor material are cooled, the vitreous enamel layer hardens to bond the resistance material to the substrate.

As shown in FIG. 1 of the drawing, a resultant resistor of the present invention is generally designated as 10. The resistor 10 comprises a ceramic substrate 12 having a layer 14 of the resistance material of the present invention coated and fired thereon. The resistance material layer 14 comprises the glass and insulating material 16, and a conductive phase of finely divided particles 18 of tin oxide ($SnO_2$), and also tantalum oxide ($Ta_2O_5$) when used. The conductive phase particles 18 are embedded in and dispersed throughout the glass and insulating material 16.

The following examples are given to illustrate certain preferred details of the invention, it being understood that the details of the examples are not to be taken as in any way limiting the invention thereto.

EXAMPLE I

A conductive phase comprising 50% by volume of tin oxide ($SnO_2$) was mixed with different quantitites of glass frit and insulating material. The glass frit was of the composition by weight of 50% BaO, 20% $B_2O_3$, and 30% $SiO_2$. The insulating material used was zirconia ($ZrO_2$). Several batches of resistive materials were made by mixing together the conductive phase, the glass frit and the insulating material, in the proportions shown in Table I. Each of the mixtures was ball-milled with butyl carbitol actetate to achieve a thorough mixture. The butyl carbitol acetate was evaporated and the mixture was blended with a squeegee medium manufactured by L. Reusche and Company, Newark, N.J. to form the resistor compositions.

Resistors were made with each of the resultant resistor compositions by screen stenciling the composition on ceramic plates to which pre-fired copper terminations had been applied. The resistors were then fired in a tunnel furnace having a nitrogen atmosphere at the peak temperatures shown in Table I over a thirty minute cycle. The resistivities for the resultant resistors are shown in Table I and in the graph of FIG. 2.

TABLE I

| | 1 | 2 | 3 |
|---|---|---|---|
| Tin Oxide (Volume %) | 50 | 50 | 50 |
| Glass (Volume %) | 50 | 40 | 35 |
| Zirconia (Volume %) | 0 | 10 | 15 |
| Resistivity (K ohms/square) Fired At | | | |
| 950° C. | 345 | 1100 | 2600 |
| 1000° C. | 135 | 1600 | 3000 |
| 1025° C. | 77 | 1700 | 2000 |

Curve A of FIG. 2, represents tin oxide resistors of the prior art which do not include the insulating material zirconia ($ZrO_2$), while curves B and C represent resistors of the invention which include 10% and 15% by volume of zirconia ($ZrO_2$). Curve A shows a high value of 345K ohms/square for resistors fired at 950° C., with a reduced resistivity of 135K ohms/square at the firing temperature of 1000° C. and a low resistivity of 77K ohms/square when the firing temperature is increased to 1025° C. On the other hand, curve B illustrates an increased resistance of 1100K ohms/square for resistors fired at 950° C., which resistivity increases respectively to 1600 and 1700K ohms/square for firing temperatures of 1000° and 1025° C. Curve C for resistors with an increased volume of zirconia shows even higher resistivities, respectively of 2600 and 3000K ohms/square for firing temperatures 950°and 1000° C., and a resistivity of 2000K ohms/square for 1025° C., which is slightly greater than the resistivity of 1700K ohms/square provided for that temperature by the resistors of curve B.

Table I and FIG. 2, thus, show that the additional of between 10 and 15% by volume of zirconia to the glaze composition materially increase the resistivity of the resistors produced when compared to the prior art tin oxide resistance material which does not include zirconia. The graph also shows that with the addition of the insulating material, an increase in the firng temperature only causes a small change in resistivity rather than materially reducing the resistivity as occurred for the prior art material of curve A. The addition of the insulating material, thus, increased the resistivities of the resistors produced and reduced their sensitivity to variation in firing temperature. In addition to their relatively high resistivity, the resistors made in accordance with the invention were not bloated and frothy, resisted chipping and breakage, and exhibited rugged physical characteristics.

EXAMPLE II

Three batches of resistance compositions were made in the manner described in Example I, except that the insulating material was calcium zirconate ($CaZrO_2$). Resistors were made of the resistance compositions in the manner described in Example I, and the resistors fired at the peak temperatures indicated providing the resistivities shown in Table II. The resistors including the insulating material provided increased resistivities, were relatively insensitive to the increase in firing temperature, and had rugged physical characteristics.

TABLE II

| | 1 | 2 | 3 |
|---|---|---|---|
| Tin Oxide (Volume %) | 50 | 50 | 50 |
| Glass (Volume %) | 50 | 40 | 35 |
| Calcium Zirconate (Volume %) | 0 | 10 | 15 |
| Resistivity (K ohms/square) Fired At | | | |
| 950° C. | 345 | 515 | 550 |
| 1000° C. | 135 | 525 | 500 |
| 1025° C. | 77 | 660 | 490 |

EXAMPLE III

Three batches of resistance compositions were made in the manner described in EXAMPLE I except that the insulating material was barium zirconate ($BaZrO_3$). Resistors were made of the resistance compositions in the manner described in Example I, and the resistors fired at the peak temperatures indicated provided the resistivities shown in Table III. The resistors including the insulating material provided increased resistivities, were relatively insensitive to the increase in firing temperature, and also had rugged physical characteristics.

TABLE III

| | 1 | 2 | 3 |
|---|---|---|---|
| Tin Oxide (Volume %) | 50 | 50 | 50 |
| Glass (Volume %) | 50 | 40 | 35 |
| Barium Zirconate (Volume %) | 0 | 10 | 15 |
| Resistivity (K ohms/square) Fired At | | | |
| 950° C. | 345 | 495 | 585 |
| 1000° C. | 135 | 245 | 340 |

EXAMPLE IV

Three batches of resistance compositions were made in the manner described in EXAMPLE I except that the insulating material was strontium zirconate ($SrZrO_3$). Resistors were made of the resistance composition in the manner described in Example I, and the resistors fired at the peak temperatures indicated provided the resistivities shown in Table IV. The resistors which included the insulating material provided increased resistivities, were relatively insensitive to the increase in firing temperature, and also had rugged physical characteristics.

TABLE IV

| | 1 | 2 | 3 |
|---|---|---|---|
| Tin Oxide (Volume %) | 50 | 50 | 50 |
| Glass (Volume %) | 50 | 40 | 35 |
| Strontium Zirconate (Volume %) | 0 | 10 | 15 |
| Resistivity (K ohms/square) Fired At | | | |
| 950° C. | 345 | 320 | 610 |
| 1000° C. | 135 | 215 | 470 |
| 1025° C. | 77 | 270 | 780 |

EXAMPLE V

Two conductive phases of tin oxide ($SnO_2$) andtantalum oxide ($Ta_2O_5$) were made by mixing together the oxides, in the proportions by volume, to provide one batch of 90% tin oxide and 10% tantalum oxide, and another batch of 75% tin oxide and 25% tantalum oxide. Batches of resistance compositions were made by mixing 50% by volume of the conducting phases with 50% by volume of the glass frit and insulating material in the proportions shown in Table V. Resistors were made in the manner described in EXAMPLE I, and the resistors fired at the peak temperatures indicated provided the resistivities shown in Table V. The resistors which included the insulating material were much less sensitive to the increase in firing temperature, and had rugged physical characteristics.

TABLE V

| | 1 | 2 | 3 | 4 |
|---|---|---|---|---|
| Tin Oxide (Volume %) | 45 | 45 | 45 | 45 |
| Tantalum Oxide (Volume %) | 5 | 5 | 15 | 15 |
| Glass (Volume %) | 50 | 40 | 40 | 30 |
| Zirconia (Volume %) | 0 | 10 | 0 | 10 |
| Resistivity (ohms/square) Fired At | | | | |
| 950° C. | 1.3M | 1.3M | 600K | 650K |

TABLE V-continued

| | 1 | 2 | 3 | 4 |
|---|---|---|---|---|
| 1000° C. | 590K | 1.0M | 270K | 500K |

From the above Examples, there can be seen the effects on the resistivity of the resistor of the present invention provided by the addition to the prior art resistor composition of the insulating material. Thus, Example I illustrates the addition of 10% and 15% by volume of zirconia ($ZrO_2$) to the composition of a tin oxide glaze material, while Table V illustrates the effect of this insulating material on a tin oxide resistance composition having tantalum oxide ($Ta_2O_5$) as an additive. Tables II, III, and IV, similarly, show the effect on the resistivity when the insulating materials calcium zirconate ($CaZrO_2$), barium zirconate ($BaZrO_3$), and strontium zirconate ($SrZrO_3$), are respectively added to the prior art tin oxide glaze composition. Resistivities varying from about 200K ohms/square to 1.3 megohms/square were provided and the effects of firing the glaze compositions at different temperatures between 950° C. and 1025° C. are also seen, especially in FIG. 2, when compared with the prior art tin oxide glaze material.

Thus, the invention provides a resistance material for making tin oxide glaze type resistors having high resistivities which were previously achieved only by increasing the glass content with the resulting physical distortion and weakness of the resistors. The examples also illustrate the effectiveness of the addition of an insulating material containing an oxide of zirconium, such as zirconia ($ZrO_2$), calcium zirconate ($CaZrO_2$), barium zirconate ($BaZrO_3$), and strontium zirconate ($SrZrO_3$), in amounts of approximately 10 to 15% by volume of the mixture. In addition to permitting higher resistivities for tin oxide type glaze resistors, the additives stabilize the resistivities achieved at increasing firing temperatures used during the making of the resistors. This reduced effect of variations in temperature during the manufacturing process, allows greater control of the resulting resistivities of the resistors. The maintenance of relatively high resistivity over a range of firing temperatures, provided by the present invention, also permits selection of various firing temperatures for achieving other desirable characteristics, without substantially changing the resistivities of the resistors produced. The resistors of the invention are also made of materials which are relatively inexpensive.

It will be seen that the objects set forth above, among those made apparent from the preceding description, are efficiently attained and, since certain changes may be made without departing from the scope of the invention, it is intended that all matter contained in the above description shall be interpreted as illustrative and not in a limiting sense.

What is claimed is:

1. An electrical resistor of relatively high resistivity and rugged physical characteristics comprising an insulating substrate and a layer of resistor material on a surface of the substrate, the resistor material including a conductive phase of particles of tin oxide embedded in and dispersed throughout a glass which includes an insulating material containing an oxide of zirconium, the glass and insulating material being present in an amount up to about 70% by volume of the resistor material.

2. An electrical resistor in accordance with claim 1 in which the insulating material is selected from the group consisting of zirconia, calcium zirconate, barium zirconate, and strontium zirconate.

3. An electrical resistor in accordance with claim 2 in which the conductive phase includes particles of tantalum oxide.

4. An electrical resistor in accordance with claim 2 in which the glass is an alkaline earth borosilicate glass.

5. An electrical resistor in accordance with claim 1, 2, 3, or 4 in which the insulating material is present in an amount of up to about 15% by volume of the resistor material.

6. An electrical resistor in accordance with claim 1, 2, 3, or 4 in which the conductive phase is present in an amount of not greater than about 50% by volume of the resistor material.

7. An electrical resistor in accordance with claim 1, 2, 3 or 4 in which the glass and insulating material are present in the amount of about 50% by volume of the resistor material, and the insulating material is present in an amount of up to about 15% by volume of the resistor material.

8. A method of making an electrical resistor of relatively high resistivity and rugged physical characteristics comprising the steps of mixing together a glass frit, an insulating material containing an oxide of zirconium, and a conductive phase of fine particles of tin oxide, the glass frit and insulating material being present in an amount up to about 70% by volume of the mixture cooling the coated substrate to form a resistor having a glass matrix with conductive particles dispersed therein.

9. The method in accordance with claim 8 in which the insulating material is selected from the group consisting of zirconia, calcium zirconate, barium zirconate, and strontium zirconate.

10. The method in accordance with claim 9 in which the conductive phase includes particles of tantalum oxide.

11. The method in accordance with claim 10 in which the glass frit is of an alkaline earth borosilicate glass.

12. The method in accordance with claim 11 in which the mixture is fired in a nitrogen atmosphere to a peak temperature of between 950° C. and 1025° C. over approximately a 30 minute cycle.

13. The method in accordance with claim 8, 9, 10 or 11 in which the insulating material is present in an amount of up to about 15% by volume of the mixture.

14. The method in accordance with claim 8, 9, 10 or 11 in which the conductive phase is present in an amount of not greater than about 50% by volume of the mixture.

15. The method in accordance with claim 8, 9, 10 or 11 in which the glass frit and insulating material are present in the amount of about 50% by volume of the mixture, and the insulating material is present in an amount of up to about 15% by volume of the mixture.

16. An electrical resistor of relatively high resistivity and rugged physical characteristics of the vitreous glaze type made by mixing together a glass frit, an insulating material containing an oxide of zirconium, and a conductive phase of fine particles of tin oxide, the glass frit and insulating material being preseint in an amount up to about 70% by volume of the mixture applying the mixture to a surface of an insulating substrate and firing same in a substantially inert atmosphere to the softening temperature of the glass frit but below the temperature at which the tin oxide melts, and cooling the coated substrate to form a resistor having a glass matrix with conductive particles dispersed therein.

17. An electrical resistor made in accordance with claim 16 in which the insulating material is selected from the group consisting of zirconia, calcium zirconate, barium zirconate, and strontium zirconate.

18. An electrical resistor made in accordance with claim 17 in which the conductive phase includes particles of tantalum oxide.

19. An electrical resistor made in accordance with claim 18 in which the glass frit is of an alkaline earth borosilicate glass.

20. An electrical resistor made in accordance with claim 19 in which the mixture is fired in a nitrogen atmosphere to a peak temperature of between 950° C. and 1025° C. over approximately a 30 minute cycle.

21. An electrical resistor made in accordance with claim 16, 17, 18, or 19 in which the insulating material is present in an amount of up to about 15% by volume of the mixture.

22. An electrical resistor made in accordance with claim 16, 17, 18, or 19 in which the conductive phase is present in an amount of not greater than about 60% by volume of the mixture.

23. An electrical resistor made in accordance with claim 16, 17, 18, or 19 in which the glass frit and insulating material are present in the amount of about 50% by volume of the mixture, and the insulating material is present in an amount of up to about 15% by volume of the mixture.

* * * * *